US012203665B2

(12) United States Patent
Leezer et al.

(10) Patent No.: US 12,203,665 B2
(45) Date of Patent: Jan. 21, 2025

(54) HYBRID WINDOW AIR CONDITIONING UNIT

(71) Applicant: Midea Group Co., Ltd., Foshan (CN)

(72) Inventors: David Leezer, LaGrange, KY (US); Zachary Chapin, Louisville, KY (US); Adam Schultz, Prospect, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 277 days.

(21) Appl. No.: 17/566,416

(22) Filed: Dec. 30, 2021

(65) Prior Publication Data

US 2023/0213214 A1 Jul. 6, 2023

(51) Int. Cl.

| | |
|---|---|
| ***F24F 1/031*** | (2019.01) |
| ***F24F 13/20*** | (2006.01) |
| ***F24F 13/32*** | (2006.01) |
| *F24F 1/0057* | (2019.01) |
| *F24F 1/027* | (2019.01) |

(52) U.S. Cl.

CPC ..... *F24F 1/031* (2019.02); *F24F 13/20* (2013.01); *F24F 13/32* (2013.01); *F24F 1/0057* (2019.02); *F24F 1/027* (2013.01); *F24F 2221/20* (2013.01)

(58) Field of Classification Search

CPC ..... F24F 1/0003; F24F 1/0007; F24F 1/027; F24F 1/0057; F24F 1/031; F24F 13/20; F24F 13/32; F24F 2221/20

See application file for complete search history.

(56) References Cited

U.S. PATENT DOCUMENTS

| | | | |
|---|---|---|---|
| 2,320,436 | A | 6/1943 | Hull |
| 2,433,104 | A | 12/1947 | Eberhart |
| 3,296,820 | A | 1/1967 | Bauman |
| 3,309,889 | A | 3/1967 | Copp |
| 3,372,557 | A | 3/1968 | Dyas et al. |
| 3,394,910 | A | 7/1968 | Ulich |
| 3,415,074 | A | 12/1968 | Metcalfe |
| 3,491,549 | A | 1/1970 | Oglesby |

(Continued)

FOREIGN PATENT DOCUMENTS

| | | | |
|---|---|---|---|
| CN | 2560895 | Y | 7/2003 |
| CN | 101876466 | A | 11/2010 |

(Continued)

OTHER PUBLICATIONS

Top Shelf A/C Corporation; Top Shelf TSB-2438 Air Conditioner Bracket; retrieved from https://www.amazon.com/TOP-SHELF-TSB-2438-Conditioner-Bracket/dp/B00NKQFSH6; Amazon; dated 2022.

(Continued)

*Primary Examiner* — Joseph F Trpisovsky

(74) *Attorney, Agent, or Firm* — Gray Ice Higdon

(57) ABSTRACT

A hybrid window air conditioning unit is disclosed. The hybrid window air conditioning unit may include an indoor unit and an outdoor unit operatively connected by a connection unit. The connection unit may have an interior channel containing refrigerant piping and electrical wiring connecting between the indoor unit and the outdoor unit. In some embodiments, the hybrid air conditioning may include a height-adjustable outdoor unit mounting assembly to allow the outdoor unit to be disposed substantially flush with or below a window.

22 Claims, 8 Drawing Sheets

(56) References Cited

U.S. PATENT DOCUMENTS

| | | | | |
|---|---|---|---|---|
| 3,554,476 | A | 1/1971 | Gaylor | |
| 3,576,114 | A | 4/1971 | Sharp et al. | |
| 4,079,813 | A | 3/1978 | Ellison | |
| 4,729,540 | A | 3/1988 | Rozema | |
| 5,027,614 | A | 7/1991 | Mori | |
| 5,035,116 | A | 7/1991 | Main | |
| 5,167,131 | A | 12/1992 | Karkhanis | |
| 5,191,770 | A | 3/1993 | Kim | |
| 5,582,025 | A | 12/1996 | Dubin et al. | |
| 5,823,289 | A | 10/1998 | Csomos | |
| 6,481,228 | B1 * | 11/2002 | Chiang | F24F 1/0035 62/223 |
| 6,568,201 | B1 | 5/2003 | Cur et al. | |
| 6,767,278 | B1 | 7/2004 | Peterson | |
| 7,296,424 | B2 | 11/2007 | Thompson | |
| 7,383,923 | B2 | 6/2008 | Patten et al. | |
| 8,167,260 | B2 | 5/2012 | Boccia | |
| 8,533,955 | B2 | 9/2013 | Agnihotri | |
| 8,584,998 | B1 | 11/2013 | Peterson | |
| 8,925,176 | B2 | 1/2015 | Choi et al. | |
| 9,163,854 | B2 | 10/2015 | Arbucci | |
| 9,222,684 | B2 | 12/2015 | Cho et al. | |
| 9,303,895 | B1 | 4/2016 | Grant | |
| 9,447,916 | B2 | 9/2016 | Darby | |
| D782,289 | S | 3/2017 | Darby | |
| 9,915,394 | B2 | 3/2018 | Chen | |
| 9,938,044 | B2 | 4/2018 | Gamboa | |
| 10,203,130 | B2 | 2/2019 | Gardikis, Sr. | |
| 10,295,221 | B2 | 5/2019 | Zhang | |
| 10,401,043 | B2 | 9/2019 | Li | |
| D884,461 | S | 5/2020 | Allen | |
| 10,739,018 | B2 | 8/2020 | Baumann et al. | |
| 10,760,795 | B2 | 9/2020 | Booten et al. | |
| 10,775,054 | B2 | 9/2020 | Bradford et al. | |
| 10,907,810 | B1 | 2/2021 | Moghal et al. | |
| 11,125,479 | B1 | 9/2021 | Ingram | |
| 11,168,920 | B1 | 11/2021 | Leezer et al. | |
| 11,339,993 | B2 | 5/2022 | Zhao | |
| 11,384,945 | B2 | 7/2022 | Aryeh | |
| 11,397,023 | B2 | 7/2022 | Xing et al. | |
| 11,397,024 | B2 | 7/2022 | Xing | |
| 11,411,527 | B2 | 8/2022 | Simon | |
| 11,415,329 | B2 | 8/2022 | Liu et al. | |
| 11,441,791 | B2 | 9/2022 | Lei et al. | |
| 11,441,792 | B2 | 9/2022 | Liang et al. | |
| 11,498,163 | B2 | 11/2022 | Li et al. | |
| 11,536,469 | B2 | 12/2022 | Si et al. | |
| 11,566,815 | B2 | 1/2023 | Martinez Galvan | |
| 11,619,241 | B2 | 4/2023 | Servies | |
| 11,835,172 | B2 | 12/2023 | Dunn | |
| 2009/0031744 | A1 | 2/2009 | D'Souza | |
| 2009/0107162 | A1 | 4/2009 | Su et al. | |
| 2009/0188174 | A1 | 7/2009 | Schreiber | |
| 2015/0192309 | A1 | 7/2015 | Frolov | |
| 2016/0131404 | A1 | 5/2016 | Mochizuki et al. | |
| 2017/0284683 | A1 | 10/2017 | Gallo | |
| 2019/0056143 | A1 | 2/2019 | Zhang | |
| 2019/0063760 | A1 | 2/2019 | Li | |
| 2019/0301668 | A1 | 10/2019 | Mai | |
| 2020/0124296 | A1 * | 4/2020 | Baumann | F24F 1/027 |
| 2020/0217521 | A1 | 7/2020 | Lundstrom | |
| 2020/0370764 | A1 | 11/2020 | Strickland | |
| 2021/0010688 | A1 | 1/2021 | Biasotti et al. | |
| 2021/0078118 | A1 | 3/2021 | Li et al. | |
| 2021/0088251 | A1 | 3/2021 | Galvan et al. | |
| 2021/0164667 | A1 | 6/2021 | Yu et al. | |
| 2021/0180828 | A1 | 6/2021 | Xing | |
| 2021/0381700 | A1 | 12/2021 | Aryeh | |
| 2022/0056715 | A1 | 2/2022 | O'Mara | |
| 2022/0228771 | A1 | 7/2022 | Si | |
| 2023/0026722 | A1 | 1/2023 | Yu | |
| 2023/0126498 | A1 * | 4/2023 | Li | F24F 1/031 454/241 |
| 2023/0213215 | A1 | 7/2023 | DeRossett et al. | |
| 2023/0213218 | A1 | 7/2023 | DeRossett | |
| 2023/0280048 | A1 | 9/2023 | Gray et al. | |
| 2023/0375222 | A1 | 11/2023 | Leezer | |

FOREIGN PATENT DOCUMENTS

| | | | |
|---|---|---|---|
| CN | 101876468 | A | 11/2010 |
| CN | 103299756 | A | 9/2013 |
| CN | 101876467 | B | 7/2014 |
| CN | 108679746 | A | 10/2018 |
| CN | 108931005 | A | 12/2018 |
| CN | 109163388 | A | 1/2019 |
| CN | 110657501 | A | 1/2020 |
| CN | 210320347 | U | 4/2020 |
| CN | 210399219 | U | 4/2020 |
| CN | 111219801 | A | 6/2020 |
| CN | 110657487 | B | 8/2021 |
| CN | 113465050 | A | 10/2021 |
| KR | 20210080821 | A | 7/2021 |
| WO | WO2018133140 | A1 | 7/2018 |
| WO | WO2018133156 | A1 | 7/2018 |
| WO | 2020224096 | A1 | 11/2020 |
| WO | WO2020220828 | A1 | 11/2020 |
| WO | WO2020220830 | A1 | 11/2020 |
| WO | WO2020224328 | A1 | 11/2020 |
| WO | WO2020228409 | A1 | 11/2020 |
| WO | WO2021050726 | A1 | 3/2021 |

OTHER PUBLICATIONS

ForestAir, The Mini Series, Retrieved from: https://www.forestair.ca/en/serie-mini-anglais , Retrieved on Oct. 27, 2021.

Appliances Connection, How to Install Friedrich Breeze through the Window, Friedrich, Retrieved from: https://www.youtube.com/watch?v=cwK2-4PaVt8 , May 9, 2013.

Electrical Know How, Electrical Wiring Diagrams for Air Conditioning Systems-Part Two, Retrieved from:http://www.electrical-knowhow.com/2014/05/electrical-wiring-diagrams-for-air-conditioning.html; Retrieved on Jul. 13, 2021.

Bright Hub Engineering, Parts of Split Air Conditioners: Outdoor Unit, Retrieved from:https://www.brighthubengineering.com/hvac/45044-parts-of-the-split-air-condioners-outdoor-unit/, Aug. 8, 2009.

Alpine Hardware, Universal Window Air Conditioner Bracket—Heavy-Duty Window AC Support—Support Air Conditioner Up to 180 lbs.—For 12000 BTU AC to 24000 BTU AC Units (Heavy Duty), Retrieved from: https://alpinehardware.com/collections/ac-brackets/products/universal-window-air-conditioner-bracket-heavy-duty-window-ac-support-support-air-conditioner-up-to-180-lbs-for-12000-btu-ac-to-24000-btu-ac-units-heavy-duty, Retrieved on: Apr. 27, 2022.

Related Applications Transmittal dated Jul. 20, 2022.

Transmittal of Related Applications dated Jan. 4, 2022.

Guan, Guang H., United States Patent and Trademark Office, Office Action issued in U.S. Appl. No. 17/566,438, 93 pages, dated Oct. 5, 2023.

Guan, Guang H., United States Patent and Trademark Office, Non-Final Office Action issued in U.S. Appl. No. 17/843,176, 81 pages, dated Jan. 22, 2024.

Trpisovsky, Joseph F., United States Patent and Trademark Office, Third Party Art Submission issued in U.S. Appl. No. 17/685,336, 35 pages, dated Mar. 4, 2024.

Trpisovsky, Joseph F., United States Patent and Trademark Office, Non-Final Office Action issued in U.S. Appl. No. 17/685,336, 52 pages, dated Apr. 1, 2024.

Guan, Guang H., United States Patent and Trademark Office, Final Office Action issued in U.S. Appl. No. 17/566,438, 52 pages, dated Apr. 25, 2024.

McNichols, Eret C., United States Patent and Trademark Office, Non-Final Office Action issued in U.S. Appl. No. 18/067,005, 90 pages, dated May 22, 2024.

Guan, Guang H., United States Patent and Trademark Office, Final Office Action issued in U.S. Appl. No. 17/843,176, 54 pages, dated Aug. 14, 2024.

(56) References Cited

OTHER PUBLICATIONS

Guan, Guang H., United States Patent and Trademark Office, Notice of Allowance issued in U.S. Appl. No. 17/566,438, 98 pages, dated Sep. 18, 2024.
McNichols, Eret C., United States Patent and Trademark Office, Notice of Allowance issued in U.S. Appl. No. 18/067,005, 72 pages, dated Oct. 16, 2024.
Trpisovsky, Joseph F., United States Patent and Trademark Office, Notice of Allowance issued in U.S. Appl. No. 17/685,336, 43 pages, dated Oct. 23, 2024.

* cited by examiner

HYBRID WINDOW AIR CONDITIONING UNIT

BACKGROUND

Air conditioning units are typically classified into split type air conditioning units and integral type air conditioning units. The split type air conditioning unit usually includes an indoor unit and an outdoor unit. The indoor unit is installed indoors, and draws indoor air into the unit to allow the drawn air to exchange heat with refrigerant, and discharges the heat-exchanged air to the conditioned indoor space. The outdoor unit allows the refrigerant introduced from the indoor unit to exchange heat with outdoor air such that the refrigerant is in a state available for heat exchange with indoor air, and then provides the refrigerant to the indoor unit. The indoor unit and the outdoor unit are usually connected to each other by a refrigerant pipe through which refrigerant flows. By contrast, the integral type of air conditioning unit (e.g., a window air conditioning unit) usually includes all the unit components, such as electrical panels, heat exchangers (e.g., evaporators, condensers), compressors, and fans, encased in a housing as a single packaged unit.

One of the advantages of the integral type air conditioning unit is that it's easy to install and thus allows consumers to install the unit themselves if they prefer. However, the integral type air conditioning unit, such as a window-mounted air conditioning unit, is often of relatively low efficiency because of the size limitations of the window-mounted packaged housing. In addition, the integral type air conditioning units generally do not come with heat pumps and therefore are suitable only for summer use. Also, as most integral type air conditioning units are mounted in a window, sunlight is blocked, the window view cannot be enjoyed, and the window cannot be opened or closed freely. Moreover, the traditional integral type air conditioning units tend to be very noisy in operation, as the noise generated by the compressor and the condenser of the air conditioning unit easily travels into the room.

The split type air conditioning unit may overcome the disadvantages of the integral type air conditioning unit as described above, with the outdoor unit being installed outside of the room. However, one of the disadvantages of the split type air conditioning unit is that it is usually more expensive for installation compared with the integral type air conditioning unit. As a result, in places where labor cost is high, the popularity of the split type air conditioning unit is low.

Accordingly, a need continues to exist in the art for a high efficiency hybrid window air conditioning unit, which has the advantages of both integral type and the split type air conditioning units, while eliminating have the aforementioned drawbacks.

SUMMARY

The herein-described embodiments address these and other problems associated with the art by providing a new hybrid window air conditioning unit design with the advantages of the integral type air conditioning unit (e.g., a window air conditioner) and the split type air conditioning unit (e.g., a mini-split), allowing traditional integral type air conditioning unit users to have the features and performance benefits of the split type air conditioning unit, but with the easier installation and enhanced window usability of the integral type air conditioning unit. The present disclosure provides a hybrid window air conditioning unit with unique features allowing high efficiency and noise reduction in an air-conditioned space. The hybrid window air conditioning unit may include an indoor unit and an outdoor unit connected by a connection unit to form a complete air conditioning system.

Another related object of the disclosure is to provide such a hybrid window air conditioning unit that permits the window to be fully open/closed. Yet another object is to provide such a hybrid window air conditioning unit that is relatively inexpensive and practicable for self-installation, and well-suited for heat pump operations. Other objects and advantages of the disclosed apparatus will become apparent from the specification and appended claims and from the accompanying drawing illustrative of the invention.

In some embodiments, a hybrid window air conditioning unit may comprise an indoor unit configured for installation on an interior wall of an air-conditioned space, an outdoor unit configured for installation exteriorly of the air-conditioned space, and a connection unit coupled between the indoor unit and the outdoor unit. The indoor unit may have an indoor housing with a front panel and a back panel, and an indoor heat exchanger and an indoor fan housed within the indoor housing. The outdoor unit may have an outdoor housing, and an outdoor heat exchanger, a compressor, and an outdoor fan housed within said outdoor housing. The connection unit may have an interior channel containing refrigerant piping and electrical wiring connecting between the indoor unit and the outdoor unit, such that the indoor heat exchanger of the indoor unit is operatively connected with the compressor and the outdoor heat exchanger of the outdoor unit through the connection unit.

In some embodiments, a hybrid window air conditioning unit may comprise a first unit, a second unit, and a connection unit operatively connecting the first unit and the second unit. The first unit may be disposed inside a room, and the second unit may be disposed outside a building and substantially flush with or below a window of the room. The connection unit may extend through the window and has an interior channel containing refrigerant piping, electrical wiring, and condensate drain piping connecting between the first unit and the second unit, such that the first unit is operatively connected with the second unit through the connection unit.

In some embodiments, a method of installing a hybrid window air conditioning unit is disclosed. The hybrid window air conditioning unit may include an indoor unit, an outdoor unit, a connection unit, an indoor unit installation plate, and an outdoor unit mounting assembly. The method may include installing the outdoor unit mounting assembly at a window; positioning the outdoor unit on the outdoor unit mounting assembly at the window; installing the indoor unit installation plate on an interior wall; mounting the indoor unit on the indoor unit installation plate; and connecting the connection unit between the indoor unit and the outdoor unit through the window.

These and other advantages and features, which characterize the invention, are set forth in the claims annexed hereto. For a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
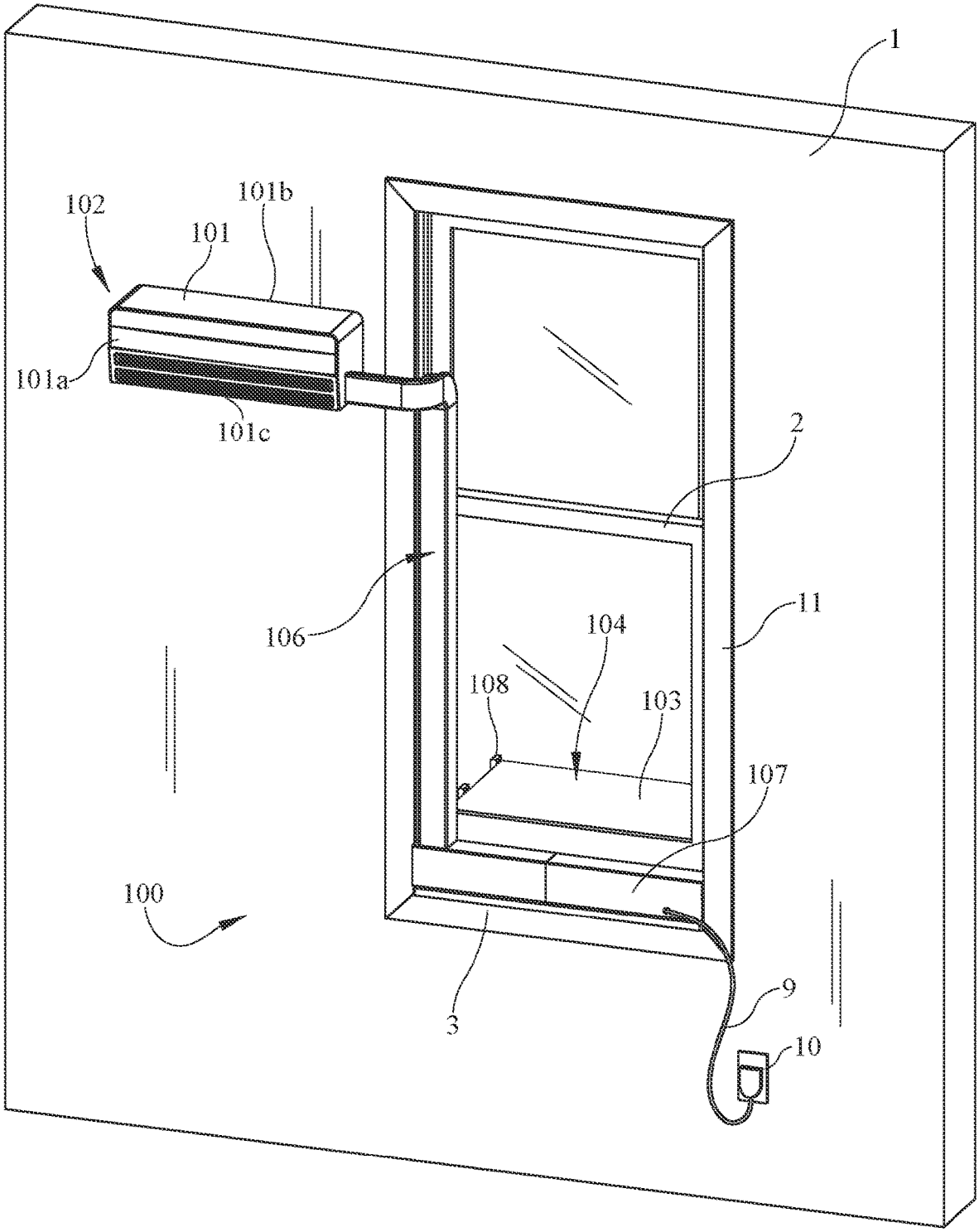
FIG. 1 is an indoor perspective view of a hybrid window air conditioning unit mounted with a vertical sliding type window, according to one embodiment.

The embodiments discussed hereinafter are directed in part to a hybrid window air conditioning unit, and a method therefor of installing the hybrid window air conditioning unit. The functionality of the disclosed apparatus is a significant improvement over known designs. The apparatus described herein not only provides an easy solution for noise reduction, heat pump operation, and efficiency improvement, but also enables a potentially easy manner of installation of unit. The embodiments shown and described include a hybrid window air conditioning unit having an indoor unit and an outdoor unit connected by a connection unit containing the piping and wiring between the indoor unit and the outdoor unit. As will be shown and described below, the hybrid window air conditioning unit, is preferably, but not necessarily, equipped with a height-adjustable outdoor unit mounting assembly. In general, the disclosed apparatus is low-priced, high-efficiency, convenient to install, and provides noise reduction and potentially a full adjustable window with a full window view.

Turning now to the drawings, wherein like numbers denote like parts throughout the several views, the overall configuration of a hybrid window air conditioning unit/apparatus 100 will now be described with reference to FIGS. 1-3, according to some embodiments. In the embodiments as shown, the hybrid window air conditioning unit 100 may be applied similarly as, for example, a spilt type air conditioning apparatus including an indoor/first unit 102, an outdoor/second unit 104, and a connection unit 106. The hybrid window air conditioning unit 100 may be applied for different room/window configurations. For example, FIG. 1 is an indoor perspective view illustrating the configuration of the hybrid window air conditioning unit 100 installed in a room with a vertical sliding window 2, while FIG. 2 is another indoor perspective view illustrating the configuration of the hybrid window air conditioning unit 100 installed in a room with a side sliding window 4.

Figure 2:
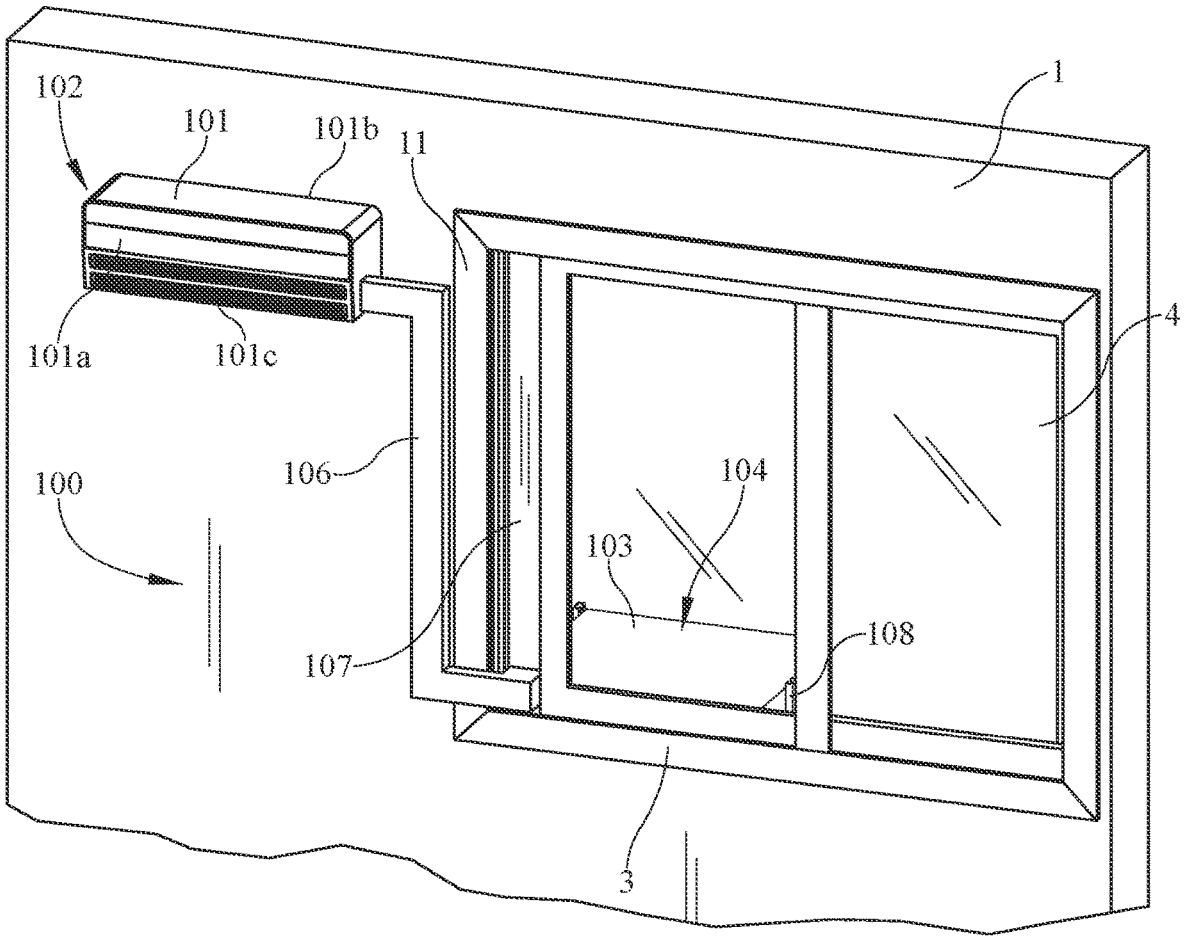
FIG. 2 is an indoor perspective view of a hybrid window air conditioning unit mounted with a side sliding type window, according to one embodiment.

As shown in FIGS. 1 and 2, the indoor unit 102 may be installed high on an interior wall 1 and include an indoor unit housing 101 with a front panel 101*a* and a back panel 101*b*. In some embodiments, the front panel 101*a* may be detachable/replaceable with different appearance design features. The indoor unit housing 101 may contain an indoor heat exchanger and an indoor fan to supply conditioned air into an air-conditioned space. The indoor heat exchanger functions as a condenser/radiator during a heating operation, and as an evaporator during a cooling operation. The indoor fan may be disposed proximate the indoor heat exchanger to direct air to the indoor heat exchanger and the air-conditioned space. In some embodiments, the indoor unit 102 may include an air inlet/outlet 101*c* in a grill/diffuser configuration on the front panel 101*a* of the indoor unit 102 for introducing air from/to the air-conditioned space. In some embodiments, the air inlet may be formed at the upper front of the indoor housing 101, and the air outlet may be formed at the lower front of the indoor housing 101. In some embodiments as shown in FIGS. 1 and 2, the air inlet/outlet 101*c* may be formed longitudinally in a horizontal direction at a lower portion of the front panel 101*a*. The air taken from the air inlet passes through the indoor heat exchanger, where the air exchanges heat. Then, the conditioned air is blown through the air outlet into the air-conditioned space. In some embodiments, a baffle vent or louver diffuser may be provided with the air inlet/outlet 101*c*, so the air inlet/outlet 101*c* may be opened/closed with the baffle or louver blade, and a direction in which air is drawn/ejected through the air inlet/outlet 101*c* may be adjusted accordingly. In some embodiments as shown in FIGS. 1 and 2, the indoor unit 102 may be mounted within approximately one to four feet from the top of the interior wall 1 to improve the airflow distribution and sound performance. In some embodiments, the indoor unit 102 may be mounted to the interior wall with a minimum of approximately one foot from a ceiling of the air-conditioned space.

Similar to the traditional split type air conditioning unit, the outdoor unit 104 of the hybrid window air conditioning unit 100 may include an outdoor unit housing 103 that contains a compressor, an outdoor heat exchanger, and an outdoor fan. The outdoor heat exchanger functions as an evaporator during a heating operation and as a condenser/radiator during a cooling operation, and the outdoor fan may be configured to direct outside air to the outdoor heat exchanger for better heat exchanging performance. In some embodiments, the outdoor unit housing 103 may include a plurality of panels (e.g., a back panel 103*a*, a top panel 103*b*. etc.). In some embodiments, an air inhalation opening/hole 103*c*, through which external air may be introduced or discharged, may be formed on one or more the panels of the outdoor unit housing 103. For example, the side or front panels the outdoor unit housing 103 may have the opening 103*c* facing outwardly to allow outside air to pass therethrough. In some embodiments, a fan guard that is formed of wires may be attached on the opening. During cooling operation, the compressor compresses the refrigerant, and the compressed refrigerant is introduced into the condenser and condensed. In such embodiments, the outdoor fan may draw the external air through back panel 103*a* to cool the condenser. In some embodiments, the outdoor unit 104 may be equipped with a variable speed inverter to configure a variable rotation speed type compressor for improved efficiency and capacity as well as low temperature heat pump operation, while the traditional integral type air conditioning units are constrained from many of these features by space limitations. The indoor unit 102 and/or the outdoor unit 104 may also include a flow rate control device, like a pressure reducing device such as an expansion valve, that reduces the pressure of the refrigerant, so the air may be conditioned by the refrigeration cycle.

Different from the traditional integral type air conditioning unit, such as with the entire unit being mounted through the window, the outdoor unit 104 of the hybrid window air conditioning unit 100 is separate from the indoor unit 102 and may be installed exteriorly of the air-conditioned space. As the outdoor heat exchanger of the outdoor unit 104 emits hot air while cooling and cold air while heating to supply cooling energy or heating energy to the indoor unit 102, respectively, the outdoor unit 104 may be installed at, for example, a position where an air passage is reserved for thermal exchange with the outdoor environment and that is not very far from the indoor unit 102, for example, on the ground, on the window balcony, on the roof, in the garage, in the yard, and the like. In some embodiments, the hybrid window air conditioning unit 100 may further include an outdoor unit mounting assembly 108 for holding the outdoor unit 104 at a window. The outdoor unit mounting assembly 108 can be of the type disclosed in copending application U.S. patent application Ser. No. 17/566,438, filed on Dec. 30, 2021, the entire contents of which is herein incorporated by reference in its entirety. In some embodiments, for example, as shown in FIG. 3, the outdoor unit mounting assembly 108 may be disposed on a window sill 3 of the window 2 and supported by an exterior wall 5. It should be understood that the outdoor unit 104 may be fixed on the outdoor unit mounting assembly 108 with various fasteners, while the outdoor unit 104 may also be placed thereon without being fastened thereto. In some embodiments, the outdoor unit mounting assembly 108 may be height-adjustable. In such embodiments, the outdoor unit 104 disposed on the height-adjustable outdoor door unit mounting assembly 108 may be adjusted to an installed position substantially flush with or below the level of the window sill 3 of the window 2 as shown in FIG. 3, so that the user may be able to open/close the window 2 freely with a full window view. In some embodiments, the height-adjustable outdoor door unit mounting assembly 108 may also be provided with a damping mechanism which increases the safety of the mounting assembly 108 by preventing accelerated movement of the outdoor unit 104 if the load or weight of the object is changed. The damping mechanism may be a coil spring, a spring damper, a pneumatic spring (gas spring), or any other type of suitable components to slow the descent of the outdoor unit 104 during installation.

Figure 4:
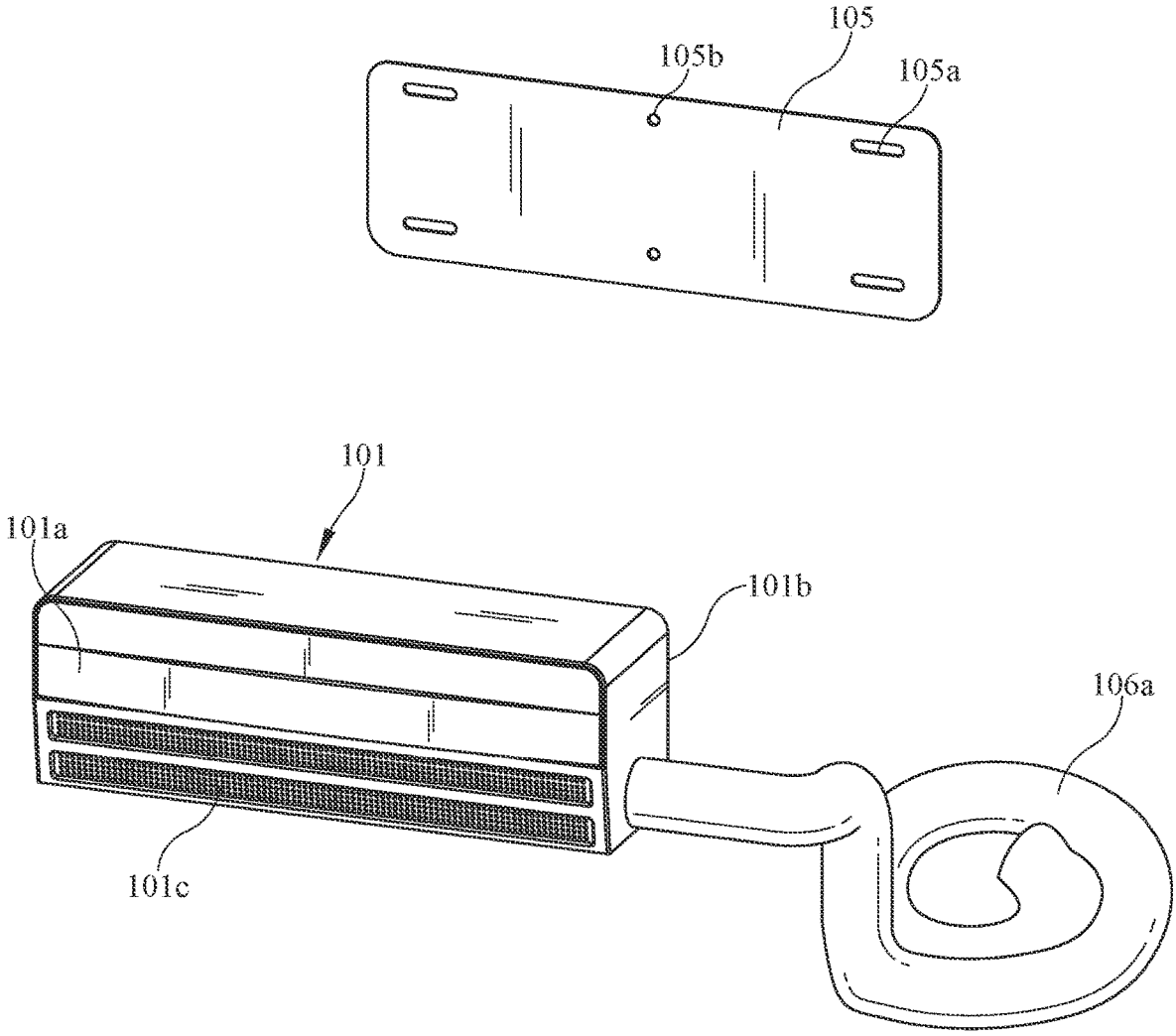
FIG. 4 is a perspective view of an indoor unit and an indoor unit installation plate, according to one embodiment.

As shown in FIG. 4, in some embodiments, the indoor unit 102 may be hung and fixed on an indoor unit installation plate 105 that is fixed to, for example, the interior wall 1 with screws or the similar fasteners. In such embodiments, the back panel 101*b* of the indoor unit housing 101 may be fixed to the indoor unit installation plate 105. For example, the indoor unit installation plate 105 may be fixed to the interior wall 1 with one or more fasteners (e.g., screws) or the like through one or more wall fastener openings 105*a*. Then, the indoor unit 102 may be hung and fixed on the indoor unit installation plate 105 through one or more indoor unit attachment openings 105*b* as shown in FIG. 4. In some embodiments, the indoor unit 102 may also be easily removed from the indoor unit installation plate 105. In some embodiments, in order to connect refrigerant piping and/or electrical wiring behind the indoor unit 102, the distance between the indoor unit installation plate 105 and the back panel 101*b* of the indoor unit 102, and the distance between the installation plate 105 and the interior wall surface 1, may be adjusted by adjusting the fasteners. For example, the back panel 101*b* of the indoor unit 102 may be spaced apart from the indoor unit installation plate 105 by a predetermined distance, thereby securing a clearance space in which the required piping and wiring may be connected to the indoor unit 102 during installation.

It should be understood that the fastener for mounting the indoor unit 102 to the indoor unit installation plate 105 and/or mounting the outdoor unit 104 to the outdoor unit mounting assembly 108 may be any other suitable configurations/mechanisms, such as, a nut combined with a screw/shaft, geometric coupling (e.g., pin and slots, French cleats, etc.), and fasteners of many types (e.g., screws, rivets, pins, ball detents, etc.). It should be also understood that various fastening features (e.g., snaps or spring clips, swaged/flared pins, bendable tabs, etc.) may be additionally provided to permit the indoor unit 102 and/or the outdoor unit 104 to be firmly secured to the indoor unit installation plate 105 and the outdoor unit mounting assembly 108, respectively, without risk of loosening or displacement, while further easing the installation process.

Figure 5:
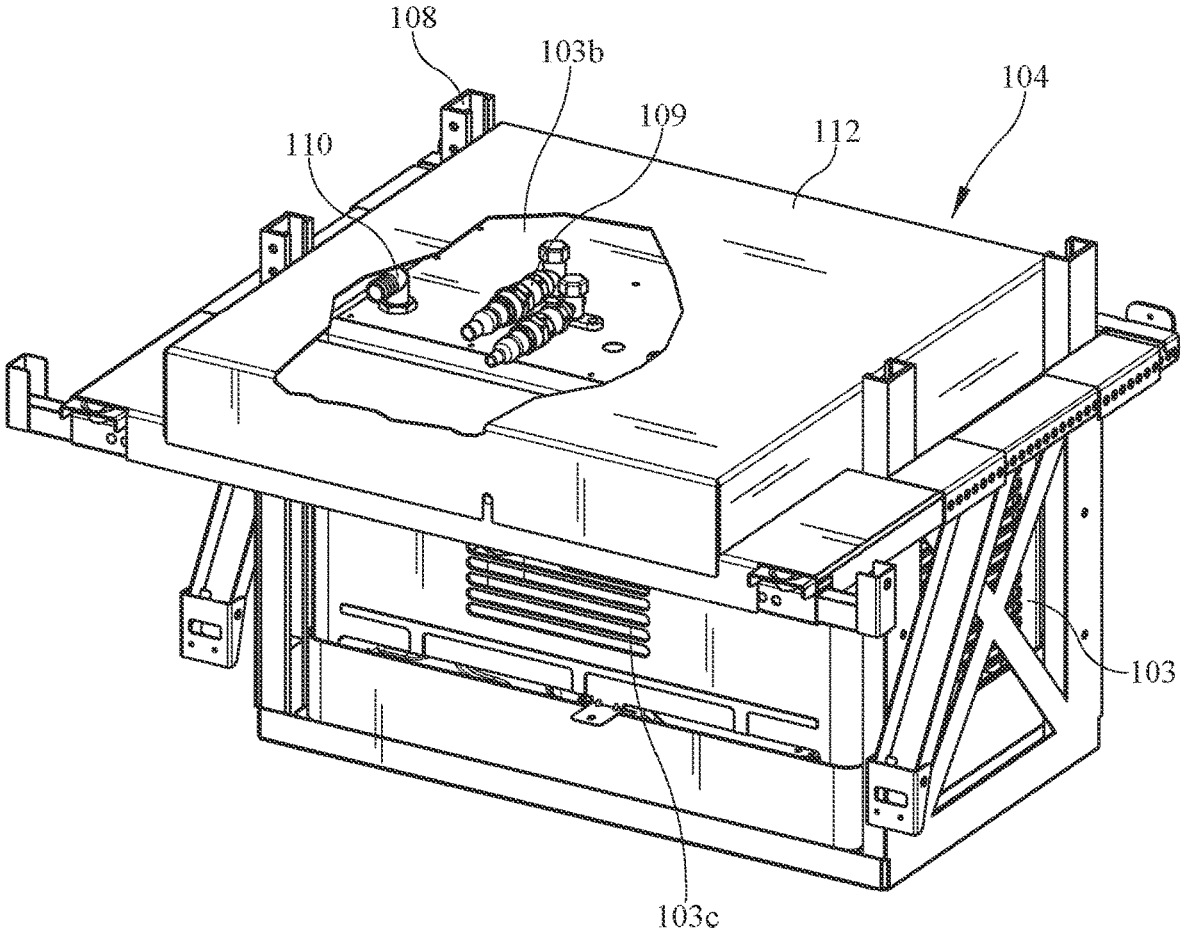
FIG. 5 is a right perspective view of the outdoor unit covered with an outdoor unit cover, according to one embodiment.

With reference to FIGS. 4 and 5 and as mentioned above, the indoor unit 102 may be connected to the outdoor unit 104 via the connection unit 106 with an interior channel thereof containing refrigerant piping and electrical wiring connecting between the indoor unit 102 and the outdoor unit 104, such that the indoor heat exchanger of the indoor unit 102 is operatively connected with the compressor and the outdoor heat exchanger of the outdoor unit 104 through the connection unit 106. For example, during cooling operation, a refrigerant may be compressed to a high pressure and a high temperature by the compressor of the outdoor unit 104. Then, the refrigerant experiences a heat exchange through the outdoor fan and a condensation effect to form a high pressure refrigerant liquid. Next, the high pressure refrigerant liquid is transferred to the indoor unit 102 through a refrigeration connection port 109, located on a top panel 103*b* of the outdoor unit housing 103, connecting a high pressure refrigerant pipe 6 within the interior channel of the connection unit 106, and the pressure of the refrigerant liquid is decreased by passing through the flow rate control device (e.g., the expansion valve). Meanwhile, the refrigerant introduced to the indoor heat exchanger (e.g., the evaporator) of the indoor unit 102 is evaporated to absorb heat from ambient air. With additional reference to FIGS. 7 and 7A, cooled air, which is formed through the absorption of heat by the evaporator, is discharged to the air-conditioned space through the indoor fan disposed adjacent to the evaporator, and a low pressure refrigerant gas, which has been evaporated by the evaporator, is transferred back to the outdoor unit 104 through the refrigeration connection port 109 connecting a low pressure refrigerant pipe 7 within the interior channel of the connection unit 106. In some embodiments, the refrigerant piping 6 and 7 within the connection unit 106 may include a quick no-leak connection port 111 as shown in FIG. 7A.

Figure 7:
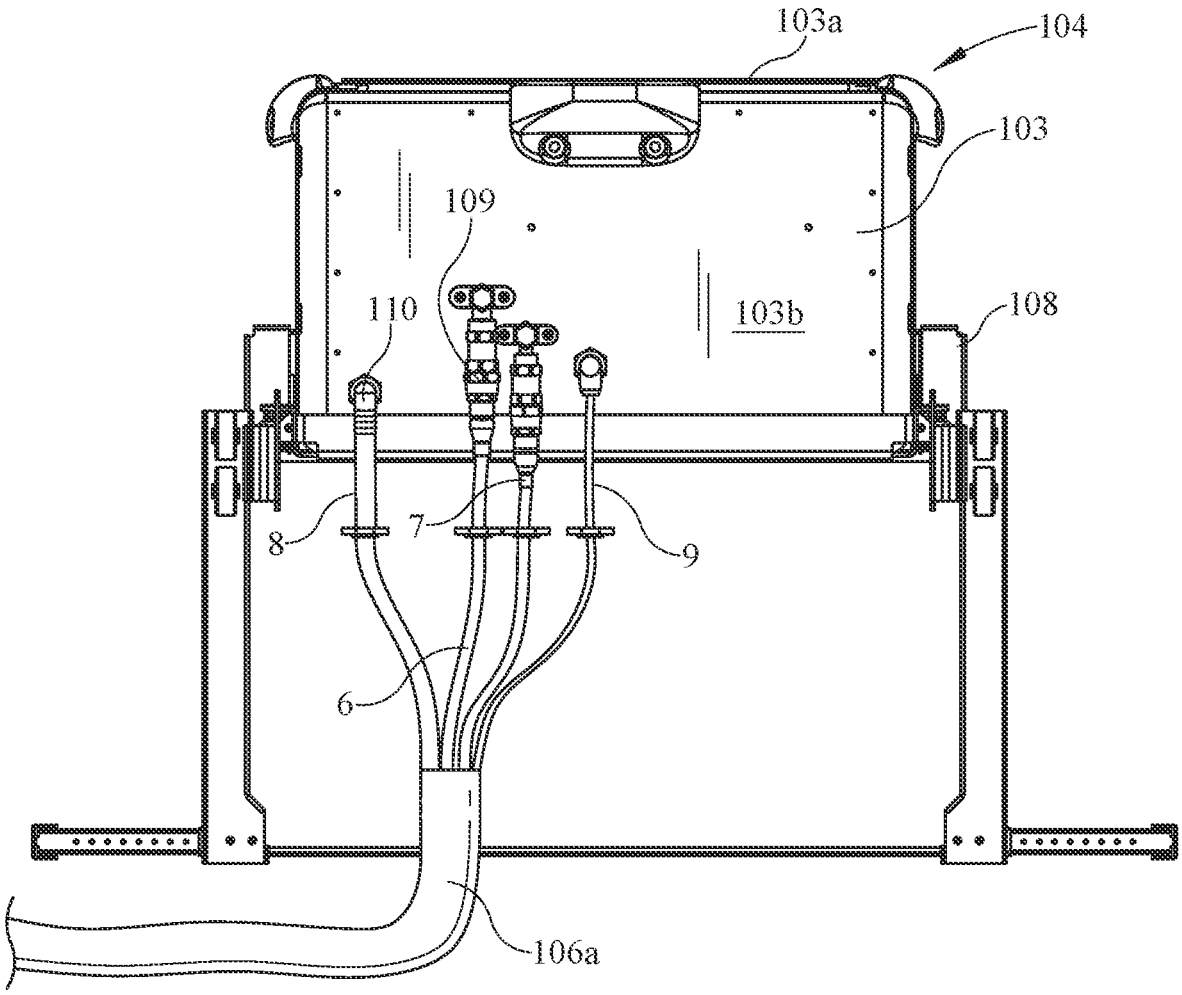
FIG. 7 is a top plan view of an outdoor unit of a hybrid window air conditioning unit, according to one embodiment.
Figure 7A:
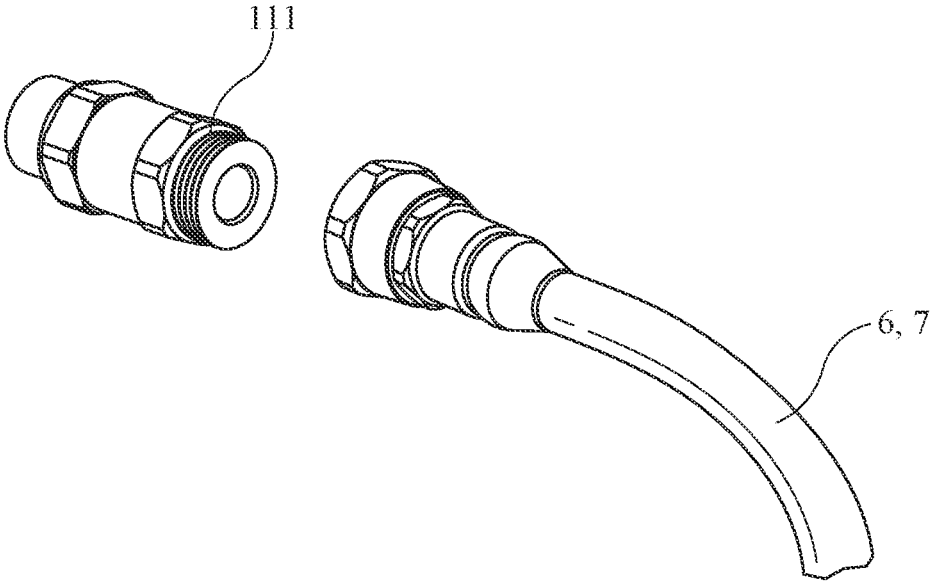
FIG. 7A is an enlarged perspective view of a quick connection for a refrigeration pipe, according to one embodiment.

In some embodiments, the connection unit 106, including the high pressure refrigerant pipe 6 and the low pressure refrigerant pipe 7, which is connected to the indoor unit 102 and the outdoor unit 104, may include additional components, such as a condensation drain pipe 8 and/or a power/electrical/communication cable 9, as shown in FIG. 7. In such embodiments, the connection unit 106 may be configured to accommodate, protect, and hide all required connection piping and wiring and between the indoor unit 102 and the outdoor unit 104 for a polished appearance. For example, the condensate drain pipe 8, which is usually supplied with the indoor heat exchanger may be a certain length of insulated drain hose with one end connected to the condensate drain pan inside the indoor unit 102 and the other end connected to a suitable condensate outlet (e.g., a drainage system) inside or, more often, outside of the air-conditioned space. In some embodiments as shown in FIG. 7, the condensate drain pipe 8 may be connected to a condensate drain connection port 110 adjacent the refrigeration connection port 109 on the top panel 103*b* of the outdoor unit housing 103. In such embodiments, the condensate disposal system (e.g., within the outdoor unit 104) may include an internal pump to facilitate the condensate drainage. In some embodiments, as shown in FIG. 1, the power cable 9 with plug may be electrically extended from the outdoor unit 104 through the connection unit 106 to electrically couple with a power outlet 10 on the interior wall 1. Therefore, the disclosed hybrid window air conditioning unit 100 may not require to alter any electrical wiring system of the air-conditioned space for installation. In such embodiments, one or more electrical cables 9 within the interior channel of the connection unit 106 may be configured to supply power to and communicate with the indoor unit 102. For example, in some embodiments, the electrical cable 9 may be used both to power the indoor heat exchanger and indoor fan as well as to provide electrical signals to enable the indoor heat exchanger to communicate with the outdoor heat exchanger and the compressor.

In some embodiments, the connection unit 106 may be made from any material (e.g., plastic, fabric, metal, etc.) that provides the properties of flexibility and weather resistance for routing the assembly through various structures, such as windows, holes in walls, ceilings, floors, and/or through long passageways, to connect the indoor unit 102 and the outdoor unit 104 together during installation. For example, in some embodiments, in order to prevent piping and cables inside from being damaged, the connection unit 106 may be manufactured from hard materials such as hard plastic or metal (e.g., stainless steel, aluminum, etc.). When the connection unit 106 is formed from a hard material, the connection unit 106 may not bend or extend significantly during installation. Thus, for the hybrid window air conditioning unit 100 according to the present disclosure, various configurations of the connection unit 106 (e.g., elongated shaped, elbow shaped, right angle shaped, curved, etc.) may be provided for combinations and connections to meet different room and window configurations. For example, in some embodiments, the connection unit 106 may include a window sealing member 107 in a horizontal orientation for a vertical sliding window 2 as shown in FIG. 1. For a side sliding window 4 as shown in FIG. 2, the window sealing member 107 may be in a vertical configuration. In such embodiments, the horizontal sealing member 107 in FIG. 1 may be configured to close off the remaining gap between the lowered window sash of the vertical sliding window 2 and the horizontal window sill 3 after installation, while the vertical sealing member 107 in FIG. 2 may be configured to close off the remaining gap between the side sliding window 4 and the vertical window jamb 11 after installation. In some embodiments, the sealing member 107 may be, for example, in an elongated rectangular configuration and made from material suitable for sealing window gaps, for example, foam.

In some embodiments, the interior channel of the connection unit 106 may also include a prefabricated interior sleeve 106*a* as shown in FIG. 4. The interior sleeve 106*a* may be in different configurations. For example, in some embodiments, the interior sleeve 106*a* may be shrink-wrapped onto the inner components (the refrigerant pipes 6 and 7, the condensate drain pipe 8, and the electrical cable 9) along the entire length of the connection unit 106 except near the ends as shown in FIG. 7. In such embodiments, the installer may only need to bundle all the connection items (e.g., two refrigerant pipes, one condensate drain pipe, and one electrical cable, etc.) together as one integral assembly to extend through the connection unit 106 so they can be installed with a minimum of labor. With the connection unit 106 and/or the interior sleeve 106*a*, an installer may avoid installing the refrigerant piping, the electrical wiring, and the condensate drain piping individually or having to tape (or otherwise bind) them together into one assembly before installation. The connection unit 106 and/or the interior sleeve 106*a* may also prevent the refrigerant piping, the electrical piping, and the condensate drain piping from becoming caught on obstructions during the installation process. In addition, the interior sleeve 106*a* combined with the connection unit 106 may provide an external covering to protect any exposed line set from ultraviolet (UV) light, physical impacts, etc., especially when certain building codes have such requirements. Some specific materials for the interior sleeve 106*a* may include but are not limited to, polystyrene, polyethylene, any polymer or film, cloth or impregnated cloth or tape, nylon, rubber, vinyl, self-fusing silicone tape, wire mesh, braided wire, or any combination thereof. In some embodiments, the interior sleeve 106*a* may also be made from a fire-resistant material.

Figure 6:
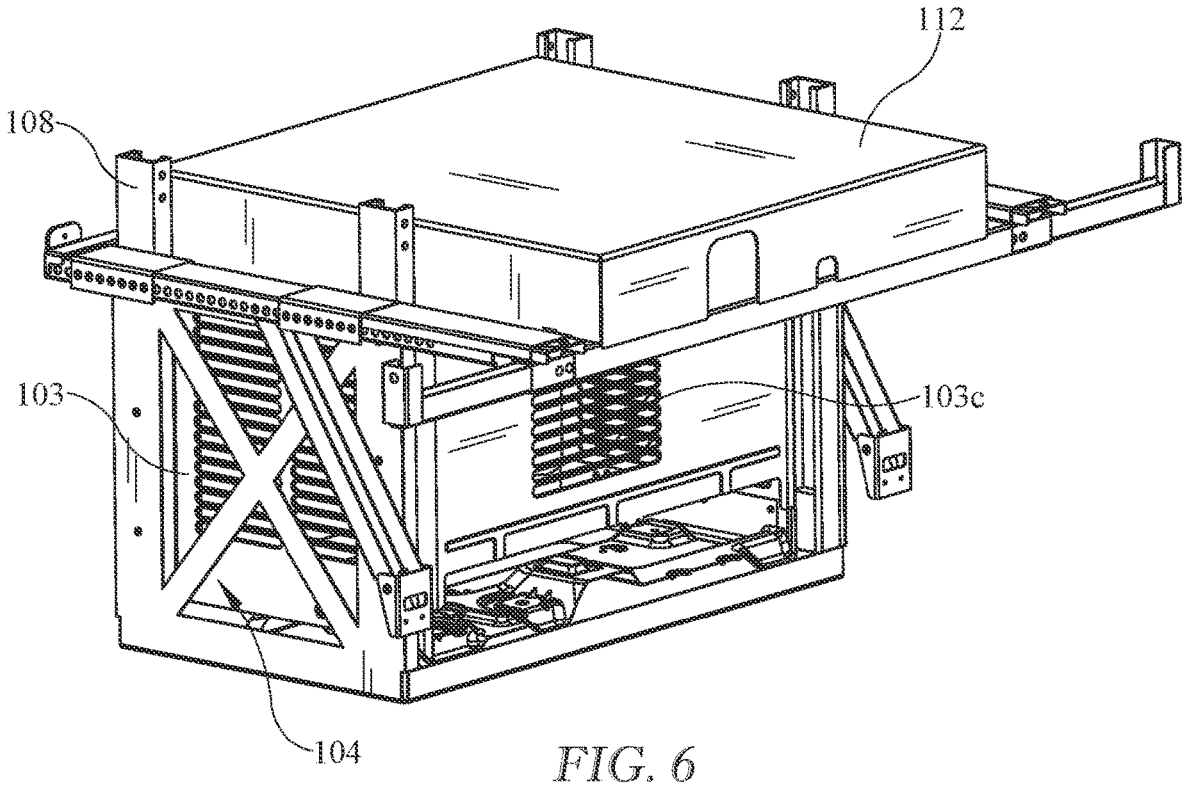
FIG. 6 is a top perspective view of the outdoor unit covered with the outdoor unit cover, according to one embodiment.
Figure 6A:
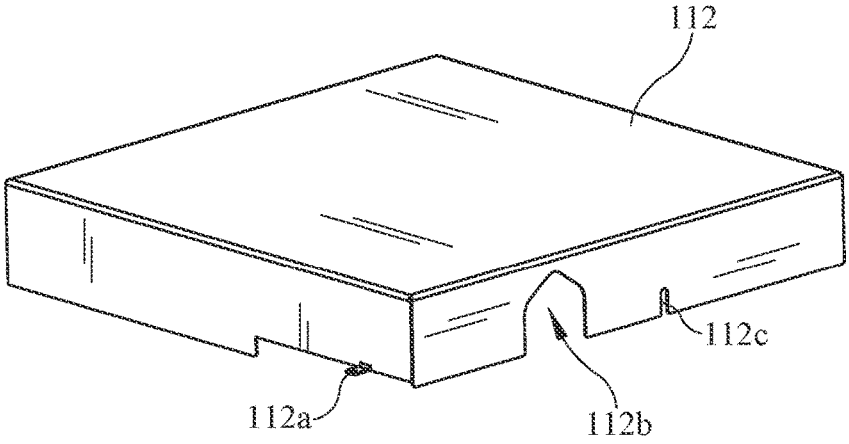
FIG. 6A is a top perspective view of the outdoor unit cover, according to one embodiment.

In some embodiments, to protect the exposed refrigeration connection port 109 and the condensate drain connection port 110 on the top panel 103*b* of the outdoor unit housing 103 and also to provide a better overall appearance, an outdoor unit cover 112 may be provided as shown in FIGS. 5, 6, and 6A. In such embodiments, the outdoor unit cover 112 may include a securing tab 112*a*, a piping gap 112*b*, and a wiring gap 112*c*. The securing tab 112*a* may be configured to firmly couple the outdoor unit cover 112 to the outdoor unit mounting assembly through fasteners. The piping gap 112*b* and the wiring gap 112*c* may be configured with various sizes/shapes for accommodating the refrigeration/condensate drain piping and the electrical wiring routing from the outdoor unit 104 to the connection unit 106. In some embodiments, the outdoor unit cover 112 may be made from metal and painted with a water proof UV-resistant material. Thus, the outdoor unit cover 112 may be configured to protect the inner components of the outdoor unit 104 and the connection ports 109 and 110 thereon from exposure to severe weather.

Figure 3:
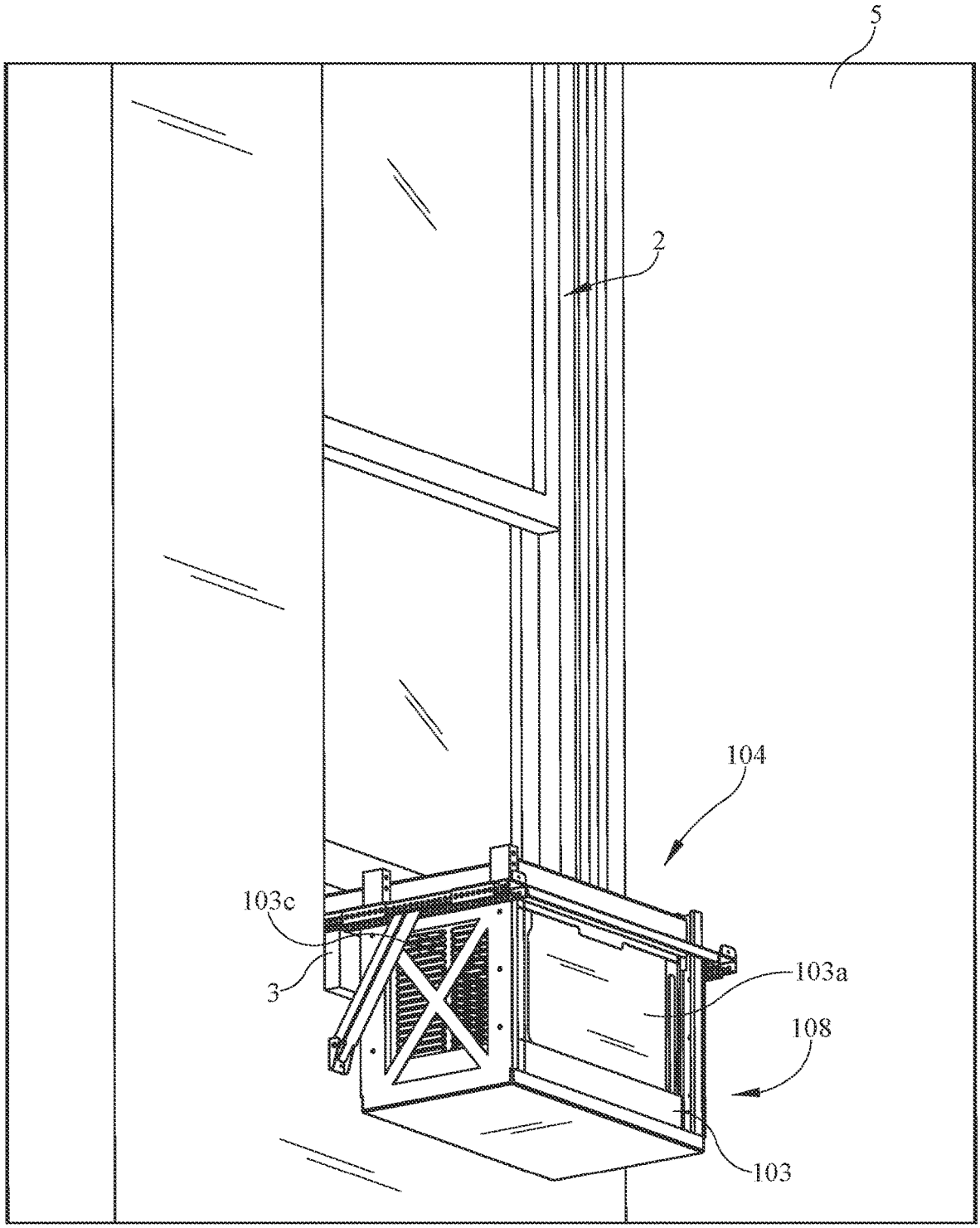
FIG. 3 is an outdoor perspective view of the hybrid window air conditioning unit of FIG. 1, according to one embodiment.
Figure 8:
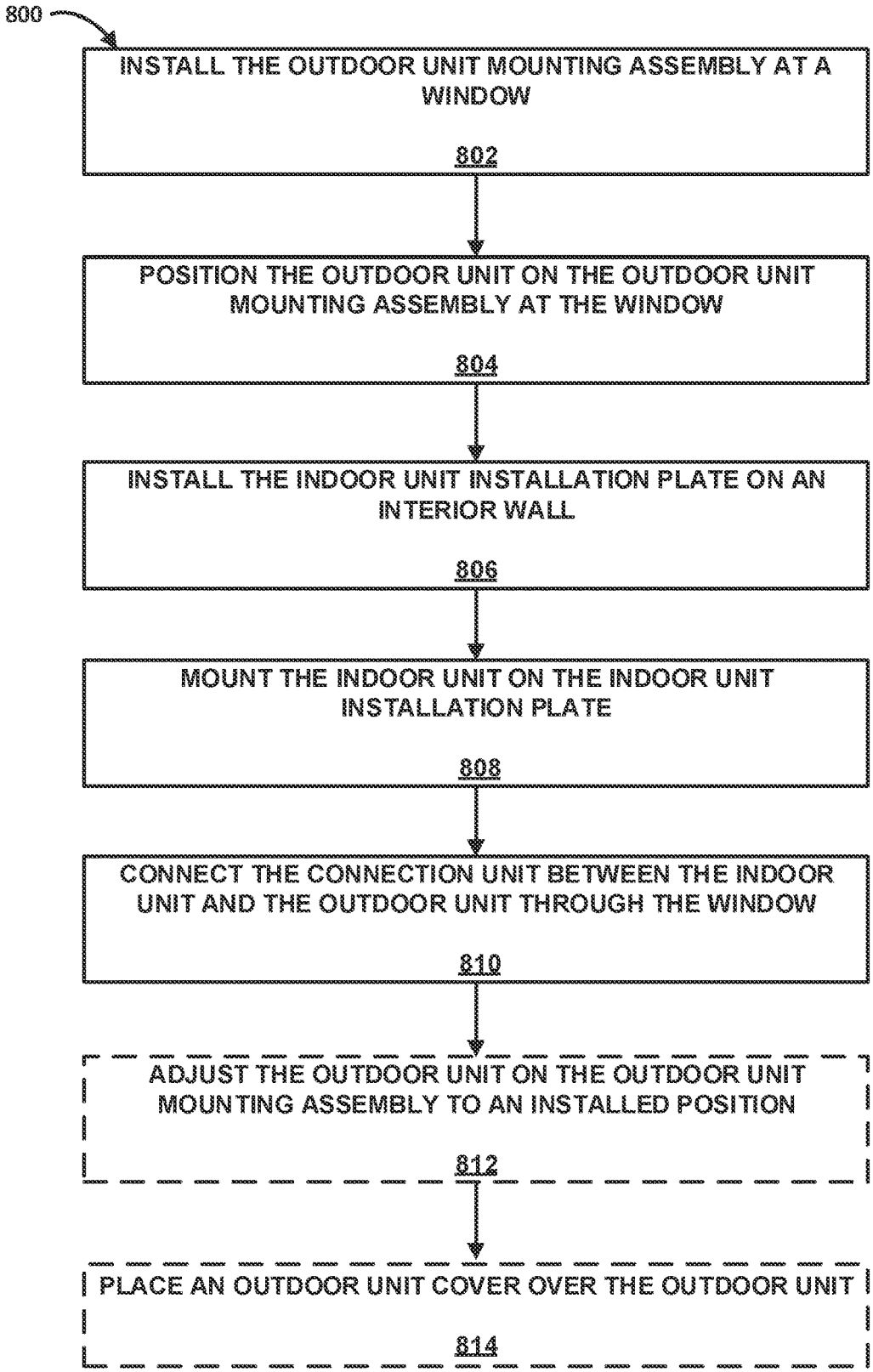
FIG. 8 is a flowchart illustrating an example sequence of installing a hybrid window air conditioning unit, according to one embodiment.

FIG. 8 illustrates a flowchart of an example sequence 800 of operations for installing the disclosed hybrid window air conditioning unit 100 as shown in FIGS. 1-3. Sequence 800 begins in block 802 by installing the outdoor unit mounting assembly 108 at the window 2 or 4. Next, the user may position the outdoor unit 104 on the outdoor unit mounting assembly 108 at the window 2 or 4 in block 804. Then, the user may install the indoor unit installation plate 105 on the interior wall 1 in block 806 so that the indoor unit 102 may be mounted on the indoor unit installation plate 105 in block 808. After both the indoor unit 102 and the outdoor unit 104 are installed, the user may use the connection unit 106 to connect the indoor unit 102 and the outdoor unit 104 together through the window 2 or 4 in block 810, therefore providing a complete air conditioning system for use. It should be understood that the order of installation of the outdoor unit 104 indicated by the blocks 802 and 804, and the installation of the indoor unit 102 indicated by the blocks 806 and 808, may be reversed in some embodiments. For example, the user may install the indoor unit 102 first before installing the outdoor unit 104. In some embodiments, the outdoor unit mounting assembly 108 may be height-adjustable, and the sequence 800 may further include lowering the outdoor unit 104 to an installed position substantially flush with or below the level of the window sill 3 of the window 2 or 4 (as shown in FIG. 3) in a dashed block 812 if desired by the user. In some embodiments, the hybrid window air conditioning unit 100 may also include the outdoor unit cover 112, and the sequence 800 may further include placing the outdoor unit cover 112 over the outdoor unit 104 as shown in FIGS. 5 and 6 in a dashed block 814 if desired by the user. In summary, the installation of the proposed hybrid window air conditioning unit 100 may be achieved by its DIY capable design without the need of a professional air conditioning technician and/or an electrician. The proposed hybrid window air conditioning unit 100 is low-priced, high-efficiency, easy to install, and quiet during operation.

It should also be understood that the disclosed hybrid window air conditioning unit 100 may be a variety of constructions, shapes, sizes, quantities, and positions but still accomplish the same intent. The elements depicted in the figures may not be drawn to scale and thus, the elements may have different sizes and/or configurations other than as shown in the figures.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. A hybrid window air conditioning unit, comprising:

an indoor unit configured for installation on an interior wall of an air-conditioned space, having an indoor housing with a front panel and a back panel, and an indoor heat exchanger and an indoor fan housed within said indoor housing;

an outdoor unit configured for installation exteriorly of the air-conditioned space, having an outdoor housing, and an outdoor heat exchanger, a compressor, and an outdoor fan housed within said outdoor housing;

a connection unit coupled between said indoor unit and said outdoor unit, wherein said connection unit has an interior channel containing refrigerant piping and electrical wiring connecting between said indoor unit and said outdoor unit, such that said indoor heat exchanger of said indoor unit is operatively connected with said compressor and said outdoor heat exchanger of said outdoor unit through said connection unit; and an outdoor unit cover, wherein said outdoor unit cover is made of metal and painted with a water proof UV-resistant material.

2. The hybrid window air conditioning unit of claim 1, wherein said indoor unit is mounted to the interior wall with a minimum of approximately one foot from a ceiling of the air-conditioned space.

3. The hybrid window air conditioning unit of claim 1, further comprising an indoor unit installation plate removably coupled to said back panel of said indoor unit housing to fasten said indoor unit to the interior wall of the air-conditioned space.

4. The hybrid window air conditioning unit of claim 1, further comprising an outdoor unit mounting assembly mounted on a window sill of a window.

5. The hybrid window air conditioning unit of claim 4, wherein said outdoor unit mounting assembly is height-adjustable.

6. The hybrid window air conditioning unit of claim 5, wherein said outdoor unit mounting assembly further includes a damping mechanism.

7. The hybrid window air conditioning unit of claim 5, wherein said outdoor unit disposed on said height-adjustable outdoor door unit mounting assembly includes an installed position substantially flush with or below the level of the window sill of the window.

8. The hybrid window air conditioning unit of claim 1, wherein said connection unit further includes condensate drain piping for conveying condensate from said indoor unit.

9. The hybrid window air conditioning unit of claim 8, wherein said outdoor unit includes a condensate drain port, and said condensate drain piping within said connection unit is connected to said condensate drain port of said outdoor unit.

10. The hybrid window air conditioning unit of claim 1, wherein said outdoor unit cover includes a prefabricated piping gap, a prefabricated wiring gap, and a prefabricated securing tab.

11. The hybrid window air conditioning unit of claim 1, wherein said connection unit is made of plastic.

12. The hybrid window air conditioning unit of claim 1, wherein said connection unit further comprises an interior sleeve.

13. The hybrid window air conditioning unit of claim 1, wherein said connection unit further comprises a window sealing member.

14. The hybrid window air conditioning unit of claim 1, further comprising a variable speed inverter for said compressor of said outdoor unit.

15. The hybrid window air conditioning unit of claim 1, wherein said refrigerant piping within said connection unit includes a quick no-leak connection port.

16. A hybrid window air conditioning unit comprising:

a first unit;

a second unit;

a connection unit operatively connecting said first unit and said second unit, wherein said first unit is disposed inside a room, said second unit is disposed outside a building and substantially flush with or below a window of the room, and said connection unit extends through the window and has an interior channel containing refrigerant piping, electrical wiring, and condensate drain piping connecting between said first unit and said second unit, such that said first unit is operatively connected with said second unit through said connection unit; and an outdoor unit cover having at least one of a prefabricated piping gap, a prefabricated wiring gap, and/or a prefabricated securing tab.

17. A method of installing a hybrid window air conditioning unit, wherein said hybrid window air conditioning unit includes an indoor unit, an outdoor unit, a connection unit, an indoor unit installation plate, and an outdoor unit mounting assembly, the method comprising:

installing said outdoor unit mounting assembly at a window;

positioning said outdoor unit on said outdoor unit mounting assembly at the window;

installing said indoor unit installation plate on an interior wall;

mounting said indoor unit on said indoor unit installation plate;

connecting said connection unit between said indoor unit and said outdoor unit through the window;

wherein said hybrid window air conditioning unit comprises an outdoor unit cover, wherein said outdoor unit cover is made of metal and painted with a water proof UV-resistant material; and placing said outdoor unit cover over said outdoor unit.

18. The method of claim 17, wherein said outdoor unit mounting assembly is height-adjustable, and the method further comprises adjusting said outdoor unit disposed thereon to an installed position substantially flush with or below the level of the window.

19. The method of claim 17, wherein the order of installing said indoor unit and said outdoor unit is reversed.

20. A hybrid window air conditioning unit, comprising:

an indoor unit configured for installation on an interior wall of an air-conditioned space, having an indoor housing with a front panel and a back panel, and an indoor heat exchanger and an indoor fan housed within said indoor housing;

an outdoor unit configured for installation exteriorly of the air-conditioned space, having an outdoor housing, and an outdoor heat exchanger, a compressor, and an outdoor fan housed within said outdoor housing;

a connection unit coupled between said indoor unit and said outdoor unit, wherein said connection unit has an interior channel containing refrigerant piping and electrical wiring connecting between said indoor unit and said outdoor unit, such that said indoor heat exchanger of said indoor unit is operatively connected with said compressor and said outdoor heat exchanger of said outdoor unit through said connection unit; and an outdoor unit cover having a prefabricated piping gap, a prefabricated wiring gap, and a prefabricated securing tab.

21. The hybrid window air conditioning unit of claim 20, further comprising an indoor unit installation plate removably coupled to said back panel of said indoor unit housing to fasten said indoor unit to the interior wall of the air-conditioned space.

22. The hybrid window air conditioning unit of claim 20, further comprising an outdoor unit mounting assembly mounted on a window sill of a window.

* * * * *